US006488014B2

(12) United States Patent
Fehlmann et al.

(10) Patent No.: US 6,488,014 B2
(45) Date of Patent: Dec. 3, 2002

(54) FUEL INJECTION PUMP

(75) Inventors: Wolfgang Fehlmann, Stuttgart (DE); Wolfgang Geiger, Remshalden (DE); Stephan Jonas, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/936,298

(22) PCT Filed: Jan. 8, 2001

(86) PCT No.: PCT/DE01/00032

§ 371 (c)(1),
(2), (4) Date: Mar. 21, 2002

(87) PCT Pub. No.: WO01/51803

PCT Pub. Date: Jul. 19, 2001

(65) Prior Publication Data

US 2002/0104515 A1 Aug. 8, 2002

(30) Foreign Application Priority Data

Jan. 12, 2000 (DE) ..... 100 00 977

(51) Int. Cl.[7] ..... F02M 37/04
(52) U.S. Cl. ..... 123/502; 123/449

(58) Field of Search ..... 123/502, 500–1, 123/449

(56) References Cited

U.S. PATENT DOCUMENTS 4,593,669 A * 6/1986 Igarashi ..... 123/502
4,753,211 A * 6/1988 Hofer ..... 123/502
5,638,794 A * 6/1997 Kubo et al. ..... 123/502
5,655,502 A * 8/1997 Enomoto et al. ..... 123/502
5,996,557 A * 12/1999 Muraki ..... 123/502

FOREIGN PATENT DOCUMENTS

JP 58 131326 8/1983

* cited by examiner

*Primary Examiner*—Thomas N. Moulis
(74) *Attorney, Agent, or Firm*—Ronald E. Greigg

(57) ABSTRACT

In a fuel injection pump with a housing, a metering pump and an injection adjuster for the metering pump, in which the injection adjuster has a piston that is acted upon by a restoring spring, the starting performance of the internal combustion engine supplied by the injection pump is to be improved by providing a starting spring which acts on the piston and acts counter to the restoring spring.

10 Claims, 3 Drawing Sheets

FUEL INJECTION PUMP

CROSS-REFERENCE TO RELATED APPLICATIONS

This application is a 35 USC 371 application of PCT/DE 01/00032 filed on Jan. 8, 2001.

BACKGROUND OF THE INVENTION

1. Field of the Invention

The invention relates to a fuel injection pump, having a metering pump and an injection adjuster for the metering pump, in which the injection adjuster has a piston that is acted upon by a restoring spring.

2. Description of the Prior Art

One fuel injection pump is known from German Patent Disclosure DE 43 44 865 A1 is a so-called distributor injection pump, in which a single pump piston of the metering pump is used to inject the correct fuel quantity into the appropriate cylinder of an internal combustion engine. During the revolution of the drive shaft, the pump piston executes as many strokes as there are engine cylinders to be supplied; the drive shaft of the fuel injection pump rotates at half the rotary speed of the engine crankshaft.

Since the fuel need not always be injected into the applicable cylinders at the same instant, with reference to the angle of rotation of the crankshaft, an injection adjuster is provided, by means of which the instant of injection can be adapted to the prevailing operating conditions of the engine. In a distributor injection pump, this is done by adjusting a cam ring, which actuates the pump piston and is driven by the drive shaft, by approximately ±10° relative to the drive shaft.

For adjusting the cam ring, the piston is provided, which is pressed by the restoring spring against an end stop. This position in contact with the end stop is equivalent to an injection adjustment in the "late" direction. In order to bring about the injection adjustment during operation, the side of the piston opposite the restoring spring is subjected to a fluid that is under pressure and that is controlled by a control slide and is furnished by a prefeed pump of the injection pump. As a consequence, however, when the fuel injection pump is at a stop, the piston of the injection adjuster is in the "late" position, since at a stop no fluid flow can be furnished, and thus only the force that is furnished by the restoring spring acts on the piston.

A disadvantage of this is that the position of the injection adjuster piston, which is predetermined by the restoring spring, at a stop is not optimal for starting an internal combustion engine supplied by the fuel injection pump.

SUMMARY OF THE INVENTION

The fuel injection pump of the invention offers the advantage that the starting spring acting counter to the restoring spring keeps the piston of the injection adjuster in the optimal position for starting the engine when the fuel injection pump is at a stop and consequently no fluid flow with which the piston could be acted upon is available. This optimal position, which is selected especially with a view to starting performance at low temperatures, can preferably be determined by adaptation of the prestressing and the spring constants of the restoring spring and the starting spring.

In a preferred embodiment, it is provided that the starting spring is disposed in the interior of the piston. This produces an especially compact structural shape.

In one embodiment, it is provided that the starting spring is braced by one end on the housing of the injection pump. In this way, a simple, open construction at little additional cost is obtained.

In an alternative embodiment, it is provided that the starting spring is braced by one end on an auxiliary piston, which is supported displaceably in a receiving bore in the piston and is braced on the housing. In this encapsulated version, only a relatively short spring is needed, and such a spring can be designed well.

To prevent the auxiliary piston from coming loose from the injection adjuster piston, a securing ring that limits the displaceability of the auxiliary piston can be disposed in the receiving bore.

BRIEF DESCRIPTION OF THE DRAWINGS

The invention is described below with specific reference to the drawings, in which.

DESCRIPTION OF THE PREFERRED EMBODIMENTS

Figure 1:
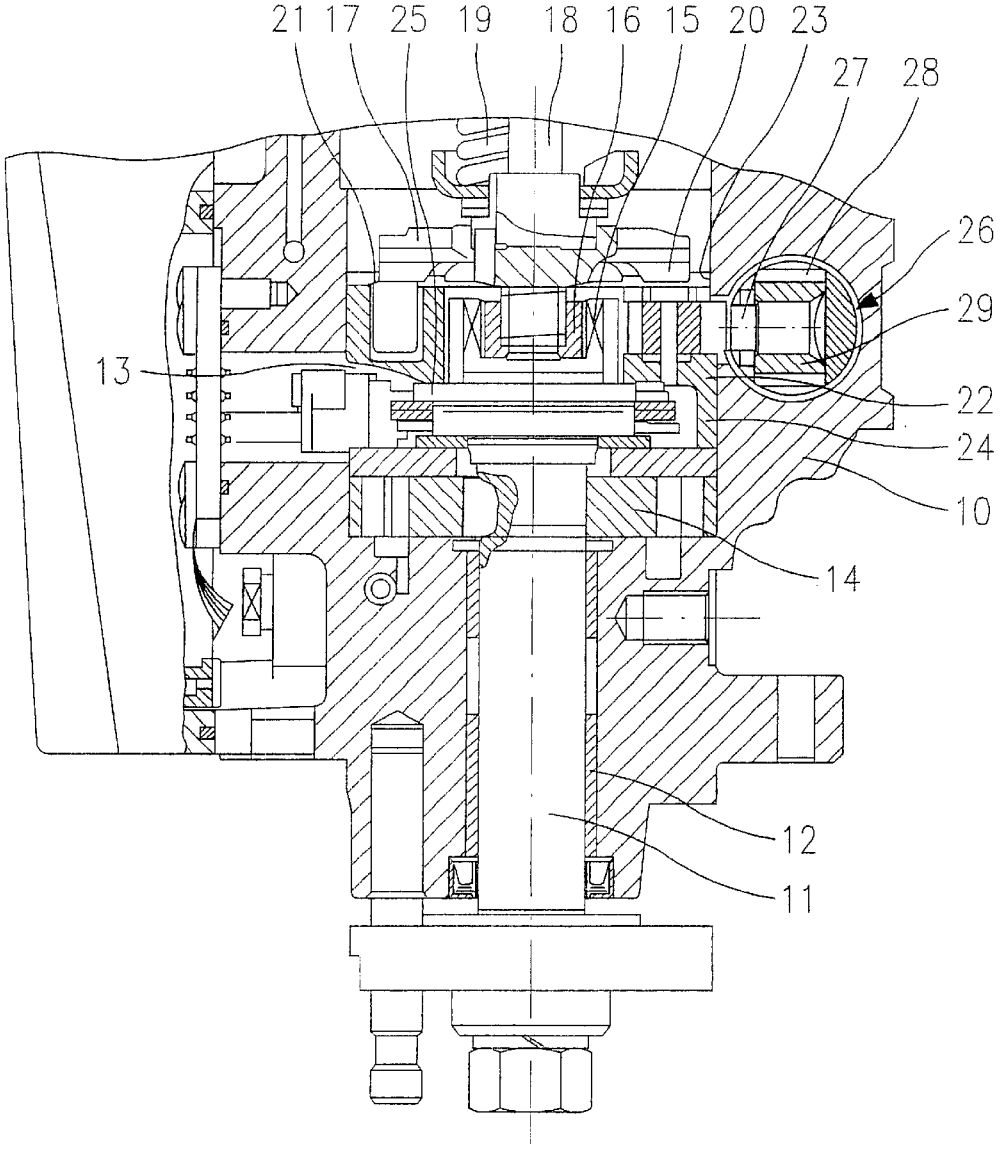
FIG. 1 is a sectional view of a fuel injection pump [in a sectional view]

The fuel injection pump, shown in part in axial longitudinal section in FIG. 1, has a housing 10 in which a drive shaft 11 is rotatably supported with slide bearings 12. The housing 10 surrounds a pump interior 13, which is filled with fuel that is under pressure. The filling of the pump interior 13 is attained with the aid of a prefeed pump 14, which is disposed in the pump interior 13 and is driven by the drive shaft 11.

On the face end of the drive shaft 11 is a pair of claws 15, which via a slaving piece 16 and suitable claws, not shown, drives an end cam plate 17 to rotate. A pump piston 18 is coupled in a manner fixed against relative rotation to the end cam plate 17 and is pressed against the end cam plate 17 by a spring 19 and presses a cam race 20, disposed on the end cam plate 17, against rollers 21, which are supported in a radial orientation in a roller ring 22. The roller ring is supported rotatably by its circular outer contour in a corresponding circular-cylindrical recess 23 in the pump interior 13 and is braced axially via an apron 24 on a disk 25 that covers the prefeed pump 14. The coupling, formed by the pair of claws 15 and the slaving piece 16, between the drive shaft 11 and the pump piston 18 protrudes through the roller ring 22.

The roller ring 22 is supported rotatably to a limited extent in the circumferential direction and is actuated by an injection adjuster 26 in a known way. To that end, the roller ring 22 is coupled to a piston 28 of the injection adjuster via a bolt 27 extending radially to the drive shaft 11. The coupling is effected via a sliding block 29.

Figure 2:
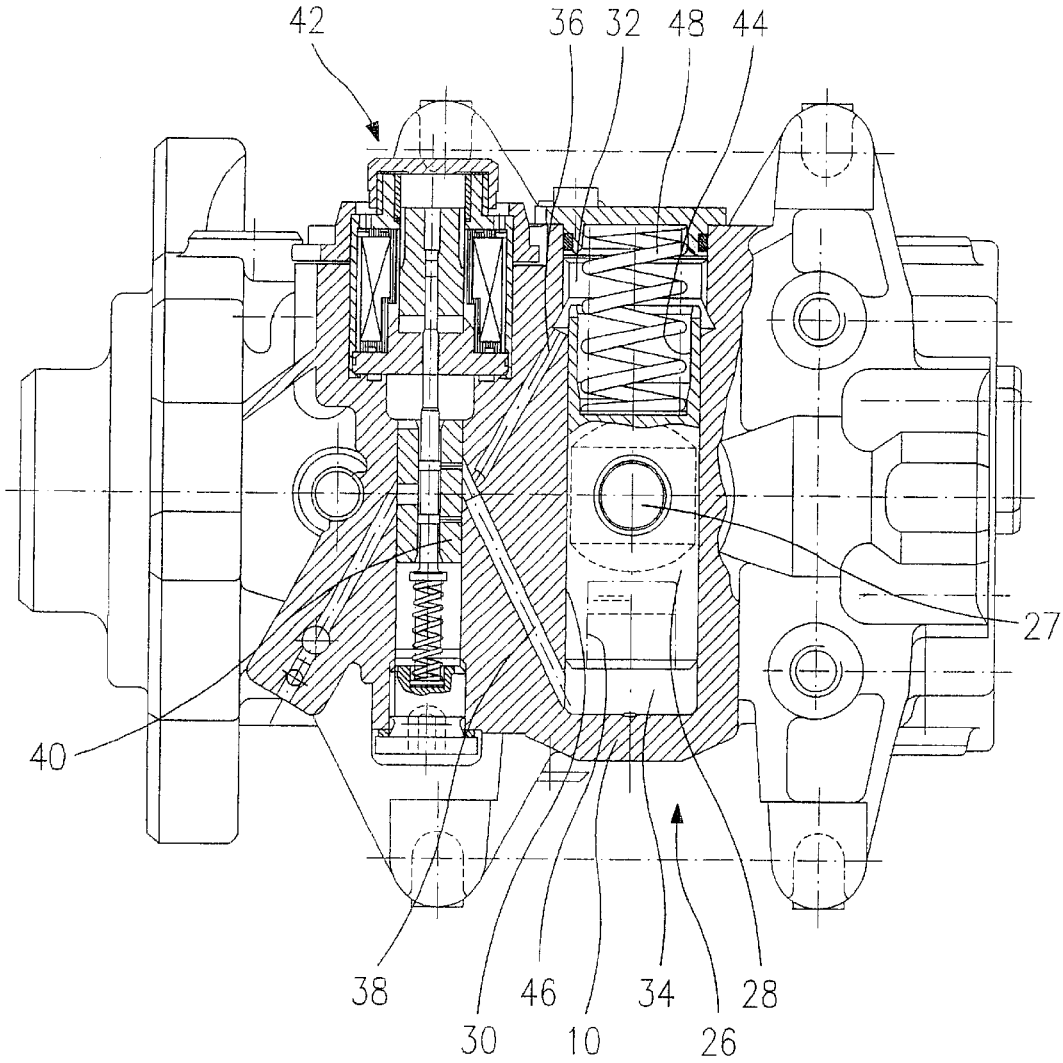
FIG. 2 is a schematic view; partially in section of an injection adjuster of a fuel injection pump of the invention.

The injection adjuster with the piston 28 can be seen in FIG. 2. The piston 28 is displaceable in a bore 30, forming two work chambers 32, 34 separated from one another by the piston 28; each of the work chambers can be supplied with fluid from a respective supply bore 36, 38. For controlling the applicable fluid flow, a control slide 40 and a proportional magnet 42 are provided.

The piston 28 is provided on its two face ends with a respective receiving bore 44 and 46, which serves to receive a spring. A restoring spring 48 is disposed in the receiving bore 44 and seeks to urge the piston 28 downward, in terms of FIG. 2, into a position in which the work chamber 34 has a minimal volume. A starting spring 50 (not shown in FIG. 2) is disposed in the receiving bore 46 and acts counter to the restoring spring 48 and thus urges the piston in the direction of a reduction in size of the work chamber 32.

Figure 3:
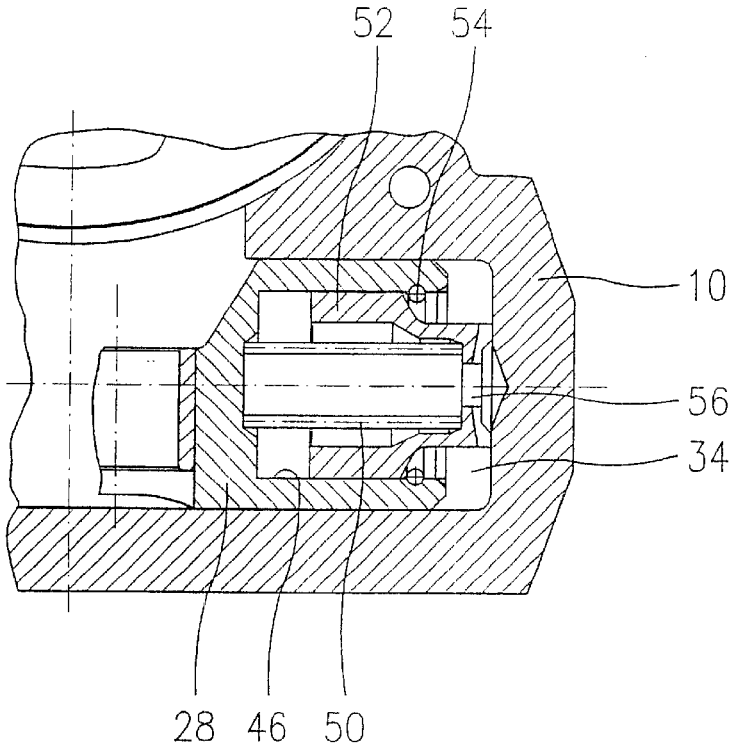
FIG. 3 is a sectional view of a detail of the piston of the injection adjuster in a first version.

In FIG. 3, the end of the piston 28 provided with the starting spring 50 is shown in a first version. An auxiliary piston 52 is disposed displaceably in the receiving bore 46 in the piston 28 of the injection adjuster; the starting spring 50 is embodied as a compression spring and is braced between the bottom of the receiving bore 46 and the head of the auxiliary piston 52. Thus the auxiliary piston 52 is urged into contact with the housing 10, and a securing ring 54 is disposed in the receiving bore 46 and prevents the auxiliary piston 52 from being forced out of the receiving bore 46 by the starting spring 50. The auxiliary piston 52 is provided with a vent opening 56, so that the chamber in which the starting spring 50 is disposed is at the same pressure as the work chamber 34.

Figure 4:
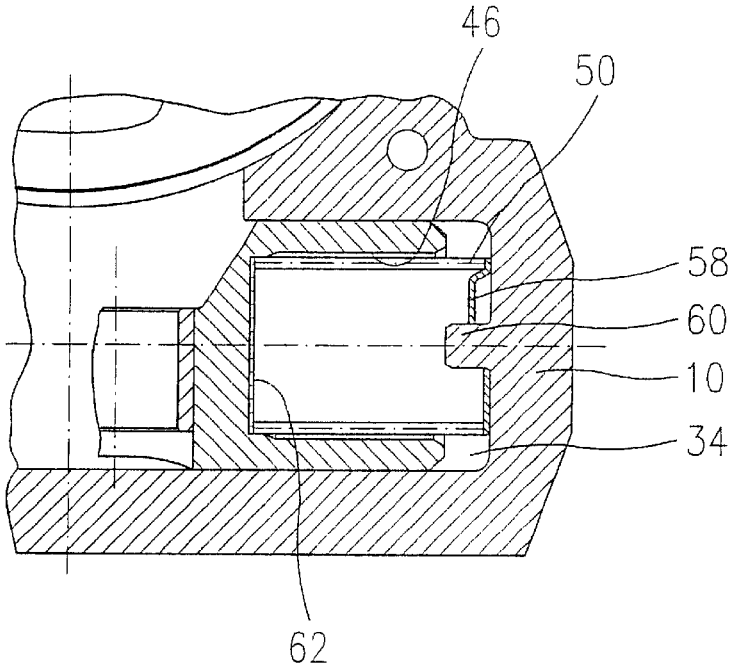
FIG. 4 is a view similar to FIG. 3 showing a second version of the piston of the injection adjuster.

A second version of the piston 28 of the injection adjuster is shown in FIG. 4. Unlike the version shown in FIG. 3, the starting spring 50 disposed in the receiving bore 46 is braced, with its end opposite the bottom of the receiving bore, directly on the housing 10, and a spring plate 58 is provided which is disposed on a centering lug 60 on the housing.

The mode of operation of the injection adjuster piston 28, provided with the restoring spring 48 and the starting spring 50, is as follows: When the fuel injection pump is at a stop, or in other words no fluid is furnished by the prefeed pump 14 via the supply bores 36, 38 to subject the work chambers 32, 34 to pressure, the piston 28 is approximately in the position shown in FIG. 2, in which the starting spring 50 assures that the piston 28 is not resting on the bottom of the work chamber 34 as would be the case in an injection pump of the prior art. The optimal early starting position of the fuel injection pump for optimal engine starting conditions is obtained in this position of the piston 28. Once the engine has been started, there is initially an rpm that is equivalent to the lower idling rpm level. First the work chamber 32 is subjected to fluid by the control slide 40, so that the piston 28 of the injection adjuster adjusts downward to the "late" position in terms of FIG. 2, and in this position it is pressed against the bottom of the work chamber 34 into the terminal position which it would assume (0° camshaft angle) if the starting spring 50 were not present. If the rpm is increased further, the pressure chamber 34 is supplied with fluid by the control slide 40, so that the piston 28 is moved back in the direction of "early". At maximum rpm, it is then at the end stop for the "early" position, which is equivalent to approximately 2° camshaft angle.

In the version shown in FIG. 3, because of the presence of the auxiliary piston 50 and the securing ring 54, the starting spring 50 is effective over an adjusting range of only about 5° camshaft angle; at a greater adjustment of the piston 28, the auxiliary piston 52 lifts away from the housing 10. The particular advantage of this version is the good designability of the spring; however, a disadvantage is that the resultant of the spring forces acting on the piston 28 experiences a kink in the range in which it lifts the auxiliary piston 52 from the housing 10.

In the version shown in FIG. 4, the starting spring 50 remains effective over the entire adjusting range of the piston 28. What is critical in this version, however, is the fatigue strength of the spring.

In the version shown in FIG. 3, the position of the piston 28 in the bore 30 is due to the disposition of the securing ring 54 in the receiving bore 56; on the assumption of a sufficiently strong dimensioning of the starting spring 50, the piston 28 is pressed by the auxiliary piston 50 so far in the direction of "early" that the auxiliary piston 52 rests on the securing ring 54. In the version shown in FIG. 4, the corresponding position of the piston 28 is due to a position of equilibrium between the forces of the restoring spring 48 and the starting spring 50. For precise calibration of this position, adjusting screws 62 can be used, which are disposed between the bottom of the receiving bore 46 and the starting spring 50.

The injection adjuster arrangement described above can also be employed for radial piston pumps. In that case, the roller ring 22 is replaced by a cam ring, which has a knuckle pin with an articulation ball. The coupling is effected by engagement of the articulation ball of the knuckle pin and a slaving bush, which in turn is pressed firmly into a transverse bore of the injection adjuster piston.

The foregoing relates to a preferred exemplary embodiment of the invention, it being understood that other variants and embodiments thereof are possible within the spirit and scope of the invention, the latter being defined by the appended claims.

What is claimed is:

1. A fuel injection pump comprising a housing (10), a metering pump (18, 20) and an injection adjuster (26) for the metering pump, said injection adjuster having a piston (28) which is displaceable in a bore (30) that it divides into work chambers (32, 34) separated from one another, said piston (28) being acted upon by a restoring spring (48), a starting spring (50) which acts upon said piston (28) and acts counter to said restoring spring, and a prefeed pump (14) which communicates with said work chambers (32, 34) via supply bores (36, 38), and a control slide (40) and a proportional magnet (42) by means of which the fluid flow through the supply bores (36, 38) can be controlled.

2. The injection pump of claim 1, wherein said control slide (40), when the injection pump is operated at an idling rpm, subjects said work chamber (32) in which said restoring spring (48) is positioned to fluid, so that said piston (28) adjusts in the direction of increasing the size of this work chamber (32), and upon a further increase in the rpm supplies the other work chamber (34) with fluid, so that the piston adjusts back again.

3. The injection pump of claim 1, wherein said starting spring (50) is disposed in the interior of the piston.

4. The injection pump of claim 3, wherein said starting spring (50) is braced by one end on the housing (10) of the injection pump.

5. The injection pump of claim 3, wherein said starting spring (50) is braced by one end on an auxiliary piston (52), said auxiliary piston being supported displaceably in a receiving bore (46) in the piston (28) and is braced on the housing (10).

6. The injection pump of claim 5, further comprising a securing ring (54), which limits the displaceability of the auxiliary piston, is disposed in the receiving bore (46).

7. The injection pump of claim 2, wherein said starting spring (50) is disposed in the interior of the piston.

8. The injection pump of claim 7, wherein said starting spring (50) is braced by one end on the housing (10) of the injection pump.

9. The injection pump of claim 7, wherein said starting spring (50) is braced by one end on an auxiliary piston (52), said auxiliary piston being supported displaceably in a receiving bore (46) in the piston (28) and is braced on the housing (10).

10. The injection pump of claim 9, further comprising a securing ring (54), which limits the displaceability of the auxiliary piston, is disposed in the receiving bore (46).

* * * * *